US005344146A

United States Patent [19]

Lee

[11] Patent Number: 5,344,146

[45] Date of Patent: Sep. 6, 1994

[54] PLAYING CARD SHUFFLER

[76] Inventor: Rodney S. Lee, 601 E. Parmelee St. #15, Buffalo, Wyo. 82834

[21] Appl. No.: 38,841

[22] Filed: Mar. 29, 1993

[51] Int. Cl.[5] ..... A63F 1/12

[52] U.S. Cl. ..... 273/149 R

[58] Field of Search ..... 273/129 R

[56] References Cited

U.S. PATENT DOCUMENTS 2,208,459 7/1940 Krueger ..... 273/149 R

FOREIGN PATENT DOCUMENTS 1107598 8/1955 France ..... 273/149 R 341727 1/1931 United Kingdom ..... 273/149 R

*Primary Examiner*—Benjamin H. Layno

*Attorney, Agent, or Firm*—Risto A. Rinne, Jr.

[57] ABSTRACT

A device for shuffling playing cards is described as having a substantially rectangular enclosure with a width that is greater than the length of the playing cards to be shuffled and a height that is less than the width of the playing cards to prevent any of the cards from turning upside down. The length of the enclosure is greater than three times the length of the playing cards to provide room for cutting the cards. Two smaller partitions are placed inside the enclosure at opposite sides to impede the side to side motion of some of the playing cards when the card shuffler is shaken from side to side. The cards whose motion has been impeded settle into various random planar alignments relative to other cards, similar to a "cutting" of the cards. Repeated shaking of the card shuffler intermingles the cards and achieves an effective shuffling action.

12 Claims, 1 Drawing Sheet

PLAYING CARD SHUFFLER

BACKGROUND OF THE INVENTION

1. Field of the Invention

The present invention, in general, relates to apparatus used to shuffle a deck of playing cards and, more particularly, to hand held portable card shuffling devices.

Playing cards are used for a variety of card games which include poker, bridge, solitaire, and other games. The need to randomly shuffle playing cards is as old as are playing cards themselves.

In addition to playing cards, it is desirable to be able to randomly shuffle cards that are use in various board games. For example, the popular board game of "Monopoly" uses two stacks of cards that players draw from in conformity with the roll of dice, which also need to be shuffled randomly prior to commencement of the play.

Card shuffling devices are known. However, they are somewhat complex in structure, which tends to make them expensive to make. As such, their use is limited today to those instances where the cost can be justified.

Accordingly, there exists a real need for an effective card shuffling device that is easy to use and is inexpensive to make.

2. Description of Prior Art

Card shuffling devices, generally, are known. For example, the following patents describe various types of these devices:

U.S. Pat. No. 449,316 to Falkingham, dated Mar. 31, 1891;

U.S. Pat. No. 750,216 to Newington, dated Jan. 19, 1904;

U.S. Pat. No. 1,434,034 to Aegerter et al, Oct. 31, 1922;

U.S. Pat. No. 2,208,459 to Krueger, dated Jul. 16, 1940;

U.S. Pat. No. 4,421,312 to Delgado et al, Dec. 20, 1983;

British Patent 4016 to Wells, that issued Feb. 11, 1893;

German Patent 252902 to V. Edler Von Pebal, Mar. 16, 1912.

While the structural arrangements of the above described devices, at first appearance, have-similarities with the present invention, they differ in material respects. These differences will be described in more detail hereinafter, since they admit of the effective use of the invention and since they admit of the advantages that are not available with the prior devices.

OBJECTS AND SUMMARY OF THE INVENTION

It is an important object of the present invention to provide a card shuffler that is easy to manufacture.

It is also an object of the invention to provide a card shuffler that is inexpensive to manufacture.

Briefly, a card shuffler that is constructed in accordance with the principles of the present invention is formed of an enclosure with a substantially rectangular, hollow interior. The height of the interior is greater than the thickness of a deck of cards but less than the width of a single card. The length of the interior is greater than three times the width of a card. Access to the hollow interior is by a hinged part of the enclosure or by a portion of the enclosure being separable. Two smaller rectangular compartments, with a thickness less than the interior height, are located in the interior at opposite corners.

DETAILED DESCRIPTION OF THE INVENTION

Figure 1:
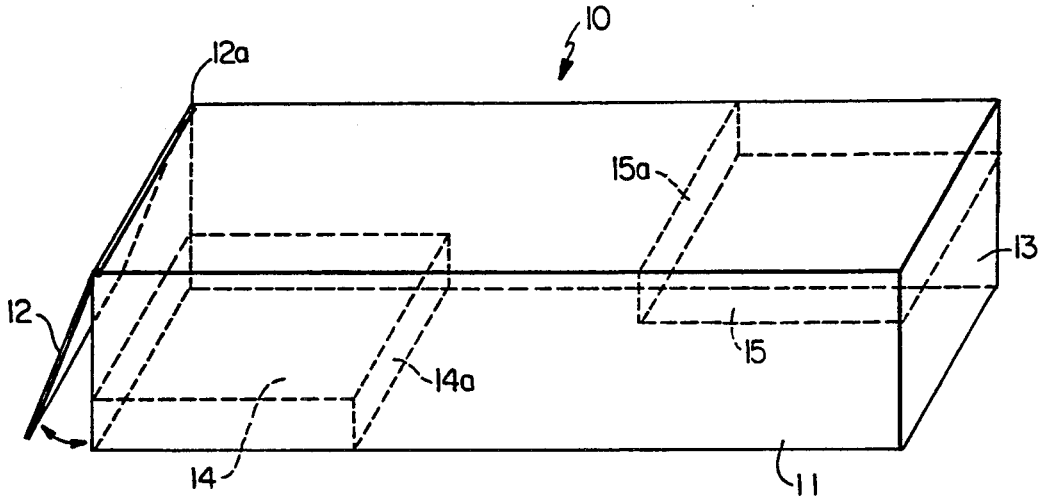
FIG. 1 is a view in perspective of a card shuffler arranged in accordance with the invention.

In FIG. 1 of the drawings, a card shuffler 10 is formed of any suitable material, such as plastic, wood, cardboard, paper, ceramic, composite materials, and the like.

The card shuffler 10 includes a rectangular enclosure 11 having a generally hollow interior with a hinged end 12 for access to the interior. The hinged end 12 is attached to the enclosure 11 by a hinge 12*a*, and the opposite end 13 is fixed.

A first rectangular partition 14 and a second rectangular partition 15 (both shown in dashed lines) are at opposite levels and at opposite ends of the enclosure 11. The rectangular shape is preferred because it presents smooth surfaces 14*a* and 15*a* against which cards will impact during the shuffling action, preventing them from becoming lodged or otherwise entangled.

The function of these surfaces 14*a* and 15*a* is to stop some of the playing cards during a side to side motion of the enclosure 11. The height and width of the partitions 14 and 15 approximate the depth and the width of a deck of playing cards to be shuffled.

The distance that each surface 14*a* and 15*a* is located within the enclosure 11 from the respective ends approximates the length of the playing cards to be shuffled. The distance between the surfaces 14*a* and 15*a* is slightly longer than the playing cards.

The interior height of the card shuffler 10 is less than the width of the playing cards, to prevent any of the cards from turning upside down during shuffling. The distance between the first surface 14*a* and the second surface 15*a* is greater than the length of the playing cards to ensure that the playing cards have enough space to change the level of one card relative to other cards, as will become clearer presently.

The actual process by which playing cards are shuffled is as follows:

In use, the hinged end 12 is raised and a deck of playing cards is placed upon the first partition 14. The hinged end 12 is closed and is held shut while the card shuffler 10 is shaken from side to side. This action causes the cards to slide back and forth within the enclosure 11.

As the cards slide back and forth, some of the cards randomly impact against either the first surface 14*a* or against the second surface 15*a*. Those cards which so impact are prevented from sliding fully to one end of the enclosure 11.

Instead, those cards whose motion has been impeded by either the first surface 14*a* or by the second surface 15*a* remain in the center area of the enclosure 11 where they fall to the bottom between the surfaces 14*a* and 15*a*. As the card shuffler 10 is shaken again, the cards intermingle with the other cards and continue to be shuffled further. The effect is to randomly change the level of some of the cards relative to other playing cards each time the card shuffler 10 is shaken.

The more times the card shuffler 10 is shaken from side to side, (or turned on end 12; then on end 13), the more thoroughly and the more randomly the resultant shuffling action becomes. The card shuffler 10 may also be turned upside down and then shaken side to side to provide an even more random card shuffling.

The final shake preferably is in a direction to cause the cards to settle towards the hinged end 12. In accordance with the location of the first partition 14, as shown in FIG. 1, it is preferable to hold the card shuffler 10 upside down for the final shake to allow all of the cards to settle towards the end 12.

The hinged end 12 is opened, and the shuffled cards are removed ready for play.

A plurality of decks of cards can be shuffled simultaneously, providing the interior dimensions of the card shuffler 10 permit a greater quantity of playing cards. When more than one deck of cards is to be shuffled, it is still necessary that the height of the enclosure 11 be less than the width of the playing cards to prevent any of the cards from flipping upside down during this shuffling activity.

Figure 2:
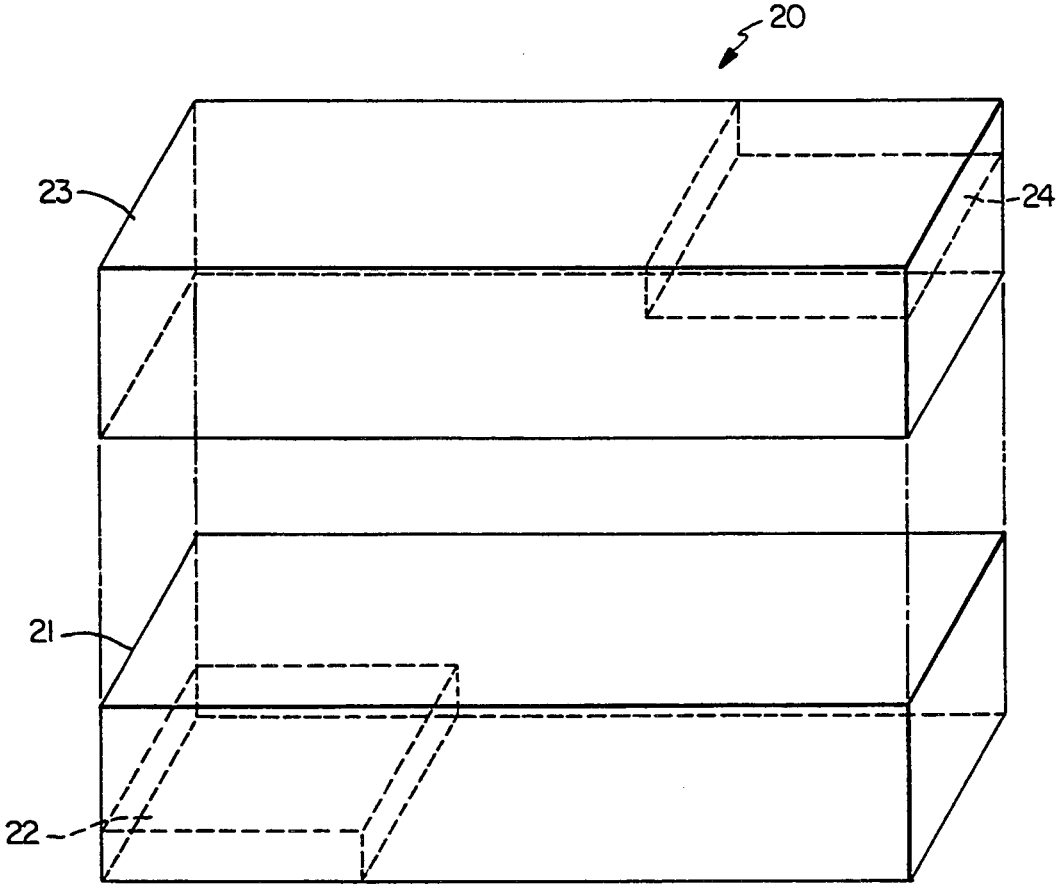
FIG. 2 is a view in perspective of the card shuffler of the invention illustrating another way of achieving access.

Referring to FIG. 2, a modified form of the card shuffler 10 is illustrated. Instead of using the hinged end 12, as shown in FIG. 1 to provide access to the inside of the enclosure 11, an enclosure 20 is divided between a bottom 21, having a lower partition 22 (shown in dashed lines), and a top 23 having an upper partition 24 (also shown in dashed lines).

The interior dimensions of the top 23 are somewhat greater than are the exterior dimensions of the bottom 21 to permit the top 23 to be placed over the bottom 21. By lifting the top 23 from the bottom 21, similar to lifting a lid from a shoe box, access is obtained to the interior of the enclosure 20.

Playing cards would be placed inside the bottom 21 on the partition 22. The top 23 then is slid over the bottom 21, and the assembled enclosure 20 is shaken, as described previously, while being held together.

Of course, with this description, other ways of achieving access to the enclosure will become apparent, all such ways that come within the scope of the appended claims are intended to come within the scope of the invention.

The invention has been shown and described in detail with reference to the presently preferred embodiment. It is understood that changes and modifications may be made without departing from the spirit and scope of the invention which is defined by the appended claims.

What is claimed is:

1. A card shuffler for shuffling a plurality of cards, comprising:

a hollow housing having a substantially rectangular interior of a predetermined size, and having first and second ends;

first card cutting means attached proximally to said first end of said hollow housing, wherein said first card cutting means includes means for defining a partition parallel with said first end;

second card cutting means attached proximally to said second end of said hollow housing, said second card cutting means being diametrically opposite to said first card cutting means, wherein said second card cutting means includes means for defining a partition parallel with said second end, and said second card cutting means is disposed from said first card cutting means sufficient to accommodate some of said plurality of cards therein; and means for providing access to said hollow housing for placing and removing said plurality of cards inside said hollow housing.

2. The card shuffler as defined by claim 1 wherein said means for defining a partition includes a block.

3. The card shuffler as defined by claim 1 wherein said means for defining a partition includes a block.

4. The card shuffler as defined by claim 1 wherein said means for providing access includes a hinged door.

5. The card shuffler as defined by claim 1 wherein said means for providing access includes means for removing a portion of said hollow housing apart from a remaining portion of said hollow housing.

6. The card shuffler as defined by claim 1 wherein said means for providing access includes an opening.

7. A card shuffler, comprising:

a substantially rectangular enclosure having a first end and a second end, an interior height less than the width of playing cards to be shuffled, an interior width greater than the width of said playing cards, and an interior length greater than three times the width of said playing cards;

first card cutting means attached contiguous with a first corner of said rectangular enclosure, said first corner being disposed at said first end thereof, the width of said first card cutting means being greater than the width of said playing cards, wherein said first card cutting means includes means for defining a partition parallel with said first end of said rectangular enclosure;

second card cutting means attached contiguous with a second corner of said rectangular enclosure, said second corner being second end thereof, the width of said second card cutting means being greater than the width of said playing cards, said second corner being diametrically opposite said first corner, wherein said second card cutting means includes means for defining a partition parallel with said second end of said rectangular enclosure and said second card cutting means is disposed from said first card cutting means sufficient to accommodate some of said playing cards therein; and means to provide access to the interior of said enclosure for placing and removing said playing cards.

8. The card shuffler as defined by claim 7 wherein said means for defining a partition includes a block.

9. The card shuffler as defined by claim 7 wherein said means for defining a partition includes a block.

10. The card shuffler as defined by claim 7 wherein said access means includes a hinged door.

11. The card shuffler as defined by claim 7 wherein said access means includes means for removing a portion of said hollow housing apart from a remaining portion of said hollow housing,

12. The card shuffler as defined by claim 7 wherein said access means includes an opening.

* * * * *